US008864531B2

(12) United States Patent
Wu et al.

(10) Patent No.: US 8,864,531 B2
(45) Date of Patent: Oct. 21, 2014

(54) CABLE ASSEMBLY WITH BETTER MECHANICAL PROPERTY

(71) Applicants: Xin-Hua Wu, Kunshan (CN); Jerry Wu, Irvine, CA (US); Li-Zhi Huang, Kunshan (CN)

(72) Inventors: Xin-Hua Wu, Kunshan (CN); Jerry Wu, Irvine, CA (US); Li-Zhi Huang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/783,400

(22) Filed: Mar. 4, 2013

(65) Prior Publication Data

US 2013/0231003 A1 Sep. 5, 2013

(30) Foreign Application Priority Data

Mar. 2, 2012 (CN) ..... 2012 1 0052615

(51) Int. Cl.
*H01R 24/00* (2011.01)
*H01R 13/58* (2006.01)
*H01R 13/56* (2006.01)

(52) U.S. Cl.
CPC ..... *H01R 13/582* (2013.01); *H01R 13/5845* (2013.01); *H01R 13/5808* (2013.01); *H01R 13/562* (2013.01)
USPC ..... 439/676

(58) Field of Classification Search
CPC ..... H01R 17/12; H01R 13/6275
USPC ..... 439/676, 345, 352, 76.1, 607.17, 660
See application file for complete search history.

(56) References Cited

U.S. PATENT DOCUMENTS

| | | | | |
|---|---|---|---|---|
| D527,709 | S | 9/2006 | Kuo | |
| 8,597,060 | B2 * | 12/2013 | Wu | 439/660 |
| 8,702,325 | B2 * | 4/2014 | Wu | 385/93 |
| 2012/0156940 | A1 * | 6/2012 | Wu | 439/660 |
| 2013/0040492 | A1 * | 2/2013 | Wu | 439/607.55 |
| 2013/0115823 | A1 * | 5/2013 | Wu et al. | 439/660 |
| 2013/0130546 | A1 * | 5/2013 | Wu et al. | 439/604 |
| 2013/0130549 | A1 * | 5/2013 | Wu et al. | 439/607.01 |

* cited by examiner

*Primary Examiner* — Phuongchi T Nguyen
(74) *Attorney, Agent, or Firm* — Wei Te Chung; Ming Chieh Chang

(57) ABSTRACT

A cable assembly includes an electrical connector and a cable. The electrical connector defines a mating port and comprising contacts with contacting portions exposing to the mating port and connecting portion. The cable includes conductive wires connecting with the connecting portion of the contact. The cable comprises a main body and an enlarged portion connecting with the contacts. The main body is configured with a same diameter and the enlarged portion is configured with an enlarged diameter than the main portion.

6 Claims, 6 Drawing Sheets

CABLE ASSEMBLY WITH BETTER MECHANICAL PROPERTY

BACKGROUND OF THE INVENTION

1. Field of the Invention

The present invention relates to a cable assembly, and more particularly to a cable with a transition end gradually enlarged.

2. Description of Related Art

A cable end of a cable assembly is usually attached to an electrical connector usually through a strain-relief device. The strain-relief device protects the cable end from being broken off when the cable assembly is bended. It is inconvenient and costs more owing to manufacturing and assembling of the strain-relief device.

Hence, a cable end with a better mechanical property is needed.

BRIEF SUMMARY OF THE INVENTION

The present invention provides a cable assembly including an electrical connector and a cable. The electrical connector defines a mating port and comprising contacts with contacting portions exposing to the mating port and connecting portion. The cable includes conductive wires connecting with the connecting portion of the contact. The cable comprises a main body and an enlarged portion connecting with the contacts. The main body is configured with a same diameter and the enlarged portion is configured with an enlarged diameter than the main portion.

Other objects, advantages and novel features of the invention will become more apparent from the following detailed description when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
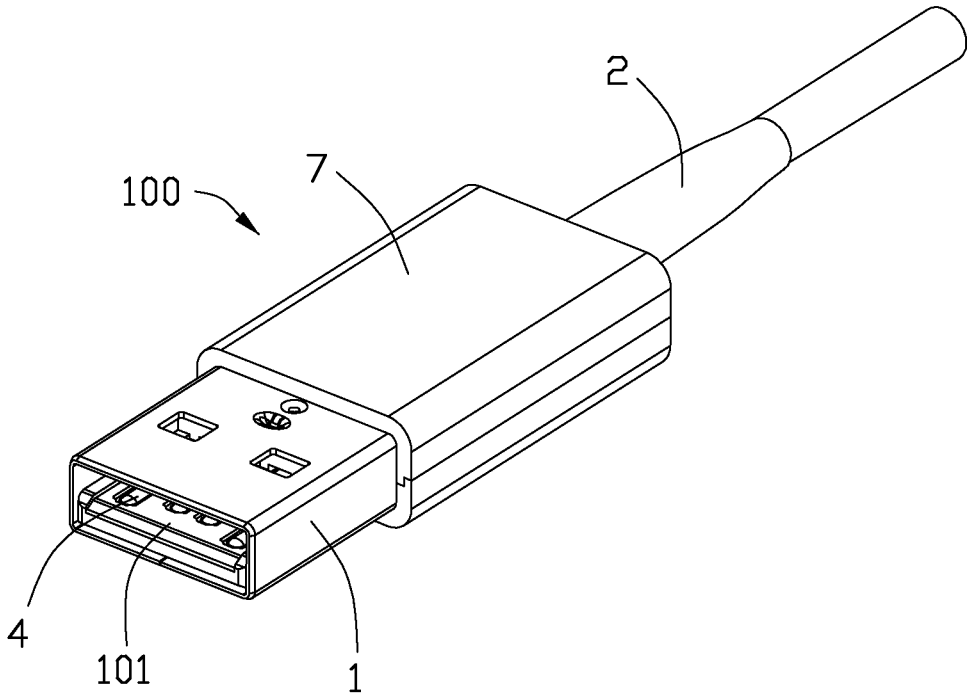
FIG. 1 is a perspective view of a cable assembly in accordance with an embodiment of the present invention.

Reference will now be made to the drawing figures to describe the preferred embodiment of the present invention in detail. FIGS. 1 to 5 illustrate a cable assembly 100, which comprised an electrical connector 1 and a cable 2 connected (both electrically and mechanically) to the electrical connector 1. The electrical connector 1 defines a mating port 101 at a front and the cable 2 is located at a back of the connector 1.

Several contacts 4 are arranged in the mating port 101 of the connector 1. The contacts 2 are surrounded and shielded by a metal shell outside.

Figure 2:
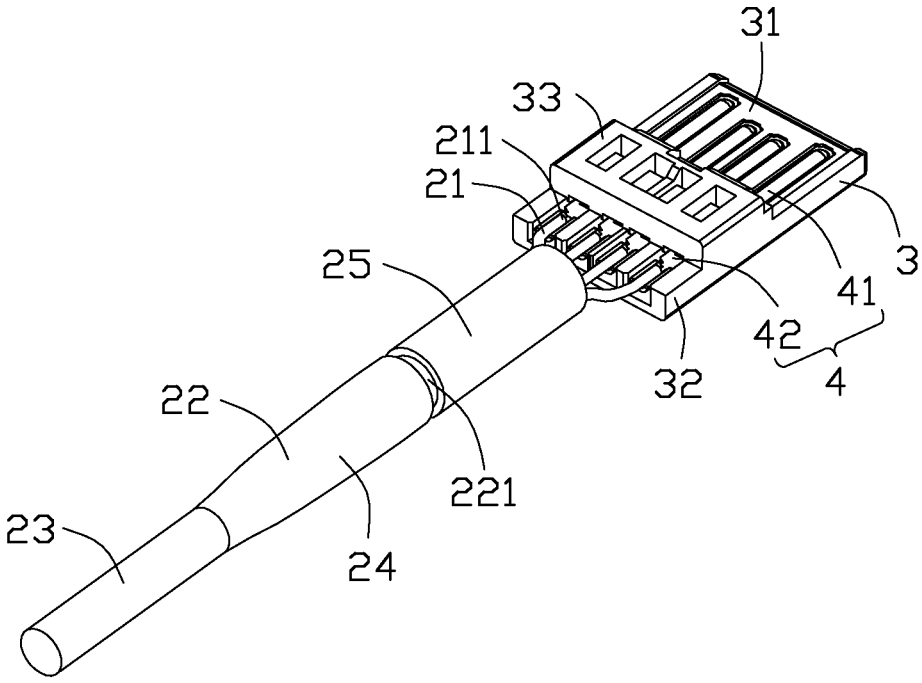
FIG. 2 is a perspective view of the cable assembly, without a shell.

Referring to FIG. 2, the electrical connector 1 includes an insulative housing 3 and said contacts 4 retained on the insulative housing. The contacts 4 comprise contacting portions 41 arranged at a front mating tongue 31 and exposed to the mating port 101, and connecting portions 42 arranged at a back mounting tongue 32 of the insulative housing 3, a partitioned rib or base 33 being defined between the mating tongue and the mounting tongue for retaining function. Connecting ends 211 of core wires 21 in the cable 2 extend in the mounting tongue 32 and soldered to the connecting portions 42 of the cable one by one. The conductive wires 21 are wrapped up with an insulating coat (not labeled). The cable 2 comprises a main body 23 and an enlarged portion 22 with variable diameters compared with the main portion, the main body and the enlarged portion is configured as the insulative coat of the cable 2. The enlarged portion 22 includes an enlarged end 25 connected with the connector 1 and a transition end 24 gradually enlarged from the main body to the enlarged end. The enlarged end 25 is directly mechanically connected to the electrical connector 1. A ring-shaped recess 221 is formed by grinding or heat pressing at a joint position between the enlarged end 25 and the transition end 24.

Figure 3:
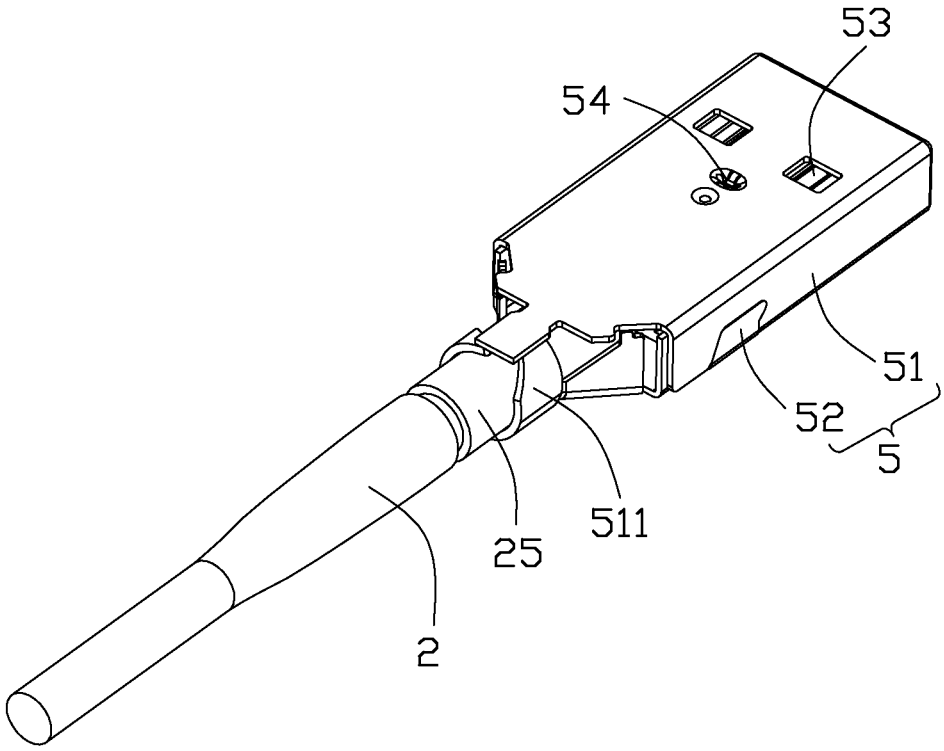
FIG. 3 is a perspective view of the cable assembly, assembled the metal shell.
Figure 4:
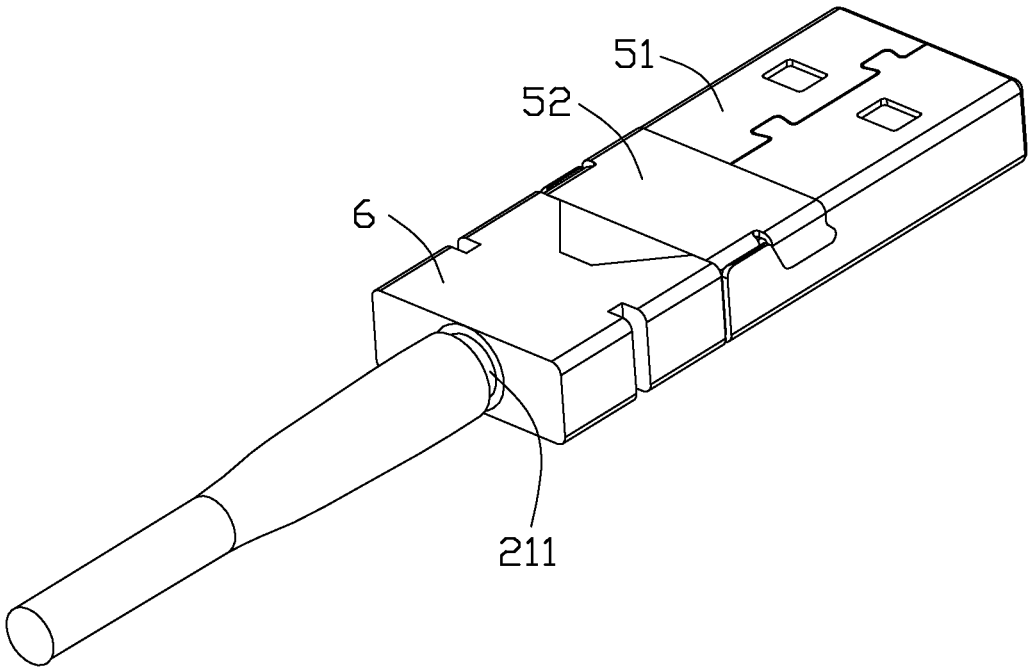
FIG. 4 is a perspective view of the cable assembly, molded with a protecting block.

Referring to FIG. 3, the metal shell 5 surrounding the insulating housing 3, includes a first shell 51 and second shell 52 combined with the each other. The first shell 51 covers the whole insulative housing 3, thereby forming the mating port 101. A ring-shaped portion 511 defined at a rear of the first shell 51 is fixed on the enlarged end 25 of the enlarged portion of the cable. A pair of holes 53 and a recess 54 is defined adjacent to the front of the mating tongue. The pair of holes 53 is used to grasp two elastic arms of a mating connector (not shown) for a stable electrically connection. Referring to FIG. 4, a protecting block 6 is formed at a connecting joint between the connector and the cable after the second shell 52 is assembled to the housing, which is formed by injection-molded process to protect the connection of the electrical connector 1 and the cable 2. It could be seen that the protecting block 6 just in front of the ring-shaped recess 221, that is, the protecting block 6 fitly surrounds the enlarged end 25 and the ring-shaped portion 511.

Figure 5:
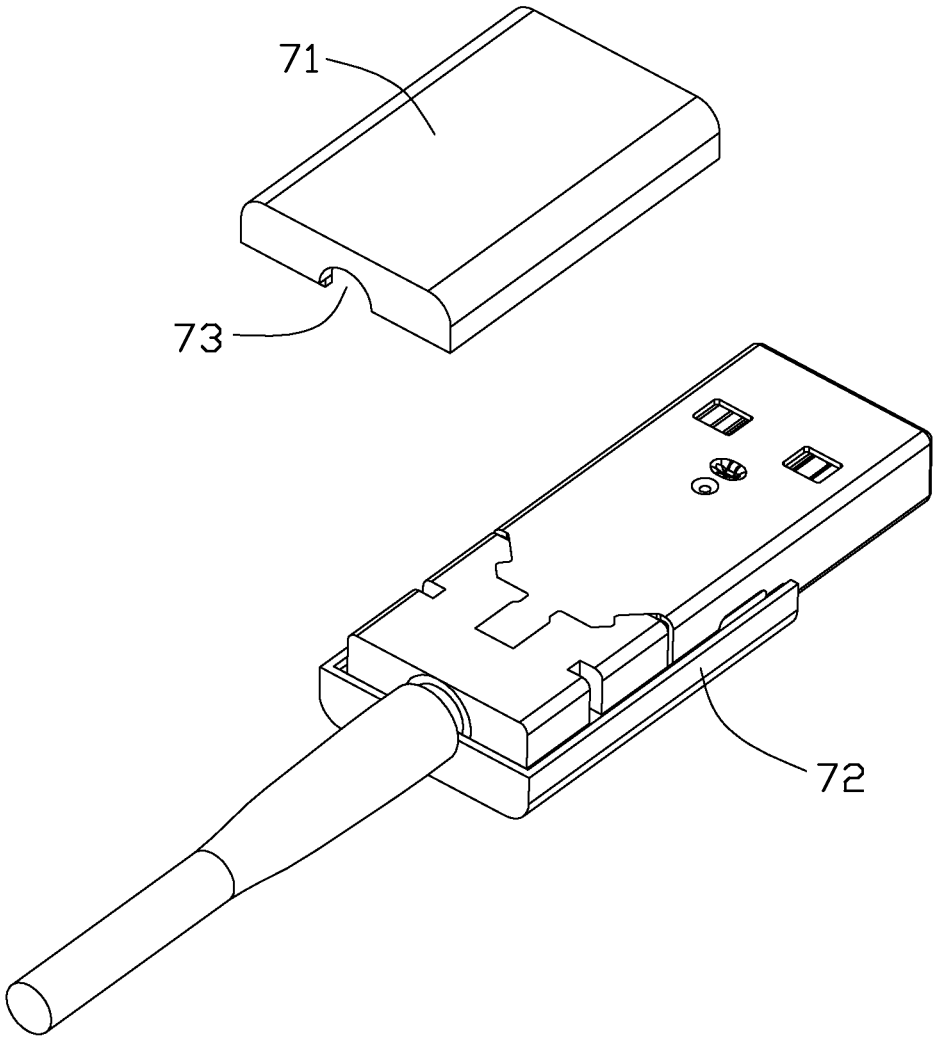
FIG. 5 is a partially exploded view of the cable assembly as shown in FIG. 1.

Referring to FIG. 5, an insulative shell 7 is set to an outside of the metal shell 5, which includes an upper shell 71 and a lower shell 72, each with a half notch 73 at a rear thereof. The two half notches 73 are set for the enlarged portion 25. The cable 2 goes through the two half notches 73 and the edges of the notches fall in and matches with ring-shaped recess 221, so that the cable 2 is further protected by the insulative shell 7. The enlarged portion 25 could play a role as a strain-relief device and protect the cable 2 from being broken off.

Figure 6:
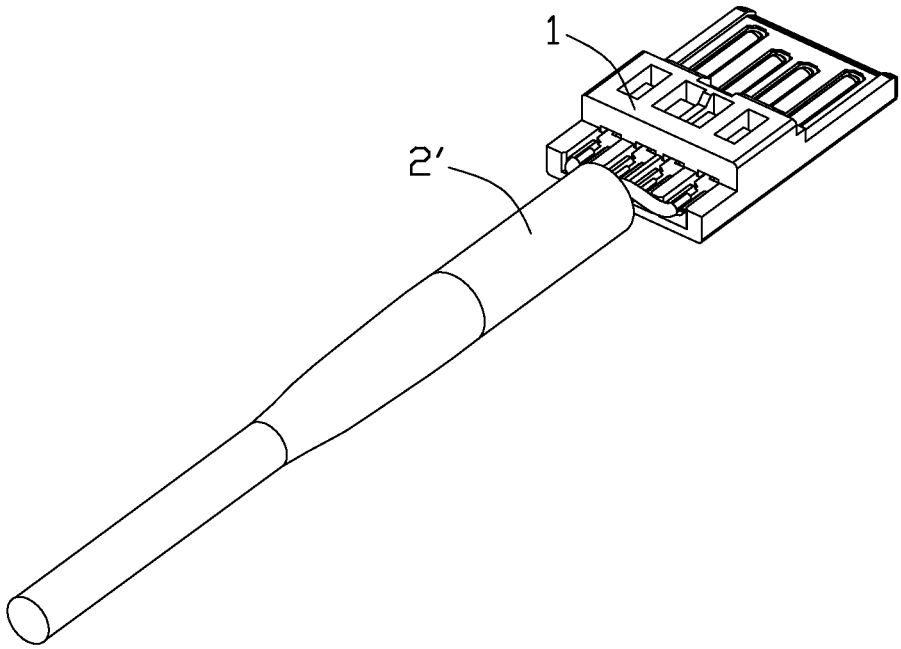
FIG. 6 is a perspective view of the cable assembly in another preferred embodiment.

FIG. 6 shows another embodiment of the present invention, the enlarged portion of the cable 2' has no ring-shaped recess. The insulative housing, the metal shell and the insulative shell is configured as a whole, which acts as a protecting device to protect connection between the electrical connector 1 and the cable 2'.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. A cable assembly comprising:

an electrical connector defining a mating port and comprising contacts with contacting portions exposing to the mating port and connecting portion;

a cable comprising conductive wires connecting with the connecting portion of the contact; wherein the cable comprises a main body and an enlarged portion connecting with the contacts, the main body is configured with a same diameter and the enlarged portion is configured with an enlarged diameter than the main portion;

wherein the enlarged portion comprises an enlarged end connecting with the contacts and a transition end gradually enlarged from the main body to the enlarged end;

wherein the cable defines a ring-shaped recess in a position between the enlarged end and the transition end;

wherein the cable assembly further comprises an insulative shell surrounding the electrical connector, the insulating shell defines a notch through which the cable goes, inside edges of the notch matches the ring-shaped recess;

wherein the electrical connector is surrounded with a metal shell there around, a protecting block is molded by injection and fitly surrounds a joint of the enlarged end of the cable.

2. A cable assembly comprising:

an electrical connector comprising contacts with front contacting portions and rear connecting portion;

a cable comprising conductive wires mechanically connecting with the connecting portions of the contacts and a coat fitly wrapped the conductive wires;

wherein the cable has an enlarging-diameter cable end directly connecting with the connecting portions, and the cable end is gradually enlarged;

wherein the cable end has an equal-diameter largest end near to the connecting portions of the contacts and a gradually-enlarged-diameter transmission portion to commonly define an enlarged portion;

wherein the enlarged portion comprises an enlarged end connecting with the contacts and a transition end gradually enlarged from the main body to the enlarged end;

wherein the cable defines a ring-shaped recess in a position between the enlarged end and the transition end;

wherein the cable assembly further comprises an insulative shell surrounding the electrical connector, the insulating shell defines a notch through which the cable goes, inside edges of the notch matches the ring-shaped recess;

wherein the electrical connector is surrounded with a metal shell therearound, a protecting block is molded by injection and fitly surrounds a joint of the enlarged end of the cable.

3. A cable connector assembly comprising:

an insulative housing;

a metallic shell enclosing said housing;

a plurality of contacts disposed in the housing, each of said contacts defining a front contacting section and a rear connecting section;

a round cable having an insulative outer jacket enclosing a plurality of isolated conductive wires, front ends of the wires electrically connecting to the rear connecting sections of the corresponding contacts, respectively; wherein the outer jacket defines a constant outer diameter along most portions thereof except a front end portion which defines another outer diameter larger than said constant diameter, and an insulative shell encloses a rear portion of the metallic shell and a front region of the front end portion of said outer jacket;

wherein a rear region of the front end portion of the outer jacket defines a tapered configuration;

wherein a ring-shaped recess is formed around the front region of the front end portion to receive a corresponding portion of the insulative shell;

wherein the cable assembly further comprises an insulative shell surrounding the electrical connector, the insulating shell defines a notch through which the cable goes, inside edges of the notch matches the ring-shaped recess.

4. The cable connector assembly as claimed in claim 3, wherein an insulative protection block is formed covering the front region of the front end portion of the outer jacket.

5. The cable connector assembly as claimed in claim 3, wherein no strain relief structure is formed on the front end portion.

6. The cable connector assembly as claimed in claim 3, wherein the front end of each of said wires is mechanically connected to the connecting section of the corresponding contact.

* * * * *